United States Patent [19]

Balmat et al.

[11] 4,088,160

[45] May 9, 1978

[54] WIRE HANDLING APPARATUS

[75] Inventors: Jack S. Balmat, Orefield; Franklin E. Timm, Bethlehem, both of Pa.

[73] Assignee: Bethlehem Steel Corporation, Bethlehem, Pa.

[21] Appl. No.: 795,584

[22] Filed: May 10, 1977

[51] Int. Cl.[2] ..... B21F 3/08

[52] U.S. Cl. ..... 140/2; 242/79

[58] Field of Search ..... 140/1, 2, 102; 242/79; 226/171, 115, 133; 34/105, 162; 198/688, 692

[56] References Cited

U.S. PATENT DOCUMENTS

| | | | |
|---|---|---|---|
| 2,743,066 | 4/1956 | Crum | 242/79 |
| 2,977,266 | 3/1961 | Sedgley | 198/692 |
| 3,443,605 | 5/1969 | Bittman et al. | 140/2 |
| 3,547,421 | 12/1970 | Hoffmann et al. | 40/2 |

*Primary Examiner*—Lowell A. Larson

*Attorney, Agent, or Firm*—Joseph J. O'Keefe; Michael J. Delaney

[57] ABSTRACT

In apparatus for depositing a series of concentric loops on a conveyor whereby due to the motion of the conveyor the loops form a series of non-concentric overlapping loops, the combination of a conveyor belt having spaced pins for engaging the loops to control the spacing between the loops and guide means to engage the loops to limit their upward movement and contain them in the spaces between the pins of the conveyor belt, so that substantially uniform spacing occurs between the non-concentric overlapping loops.

7 Claims, 9 Drawing Figures

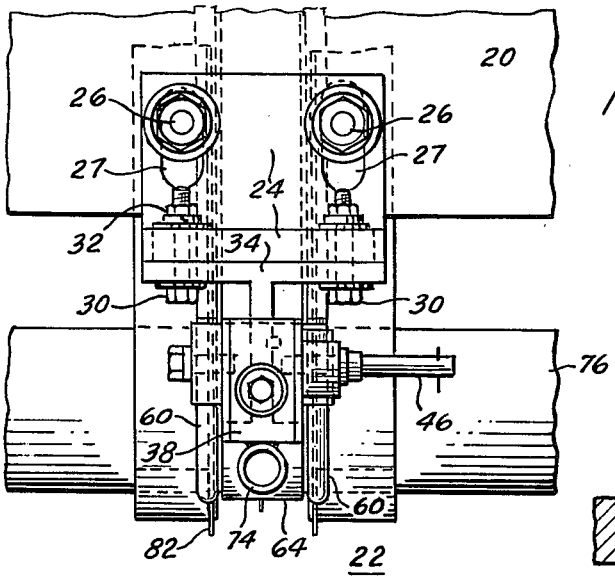
FIG. 4
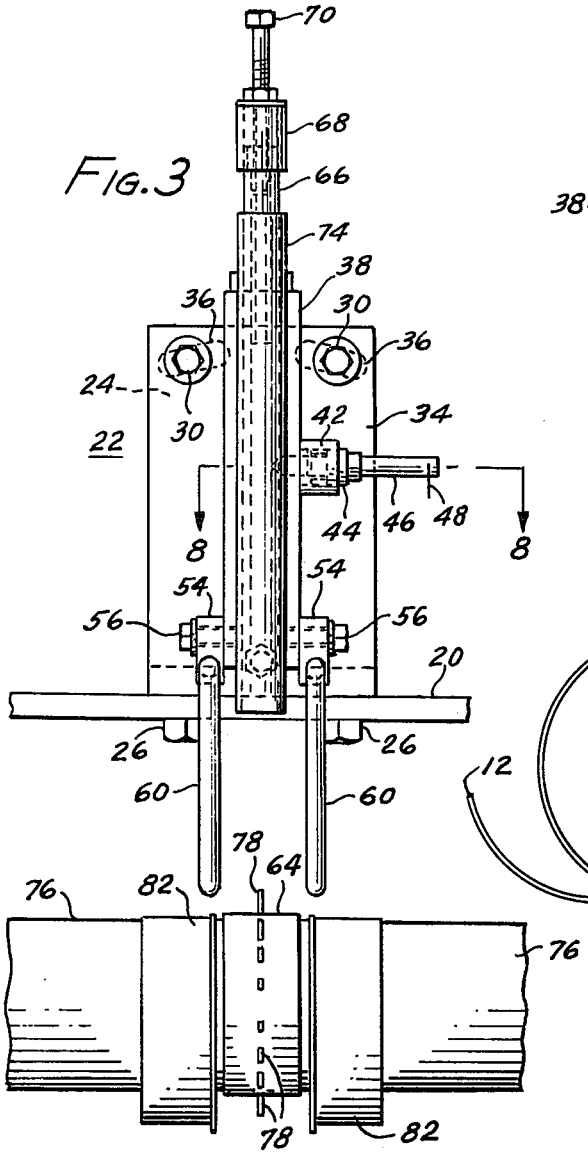
FIG. 3
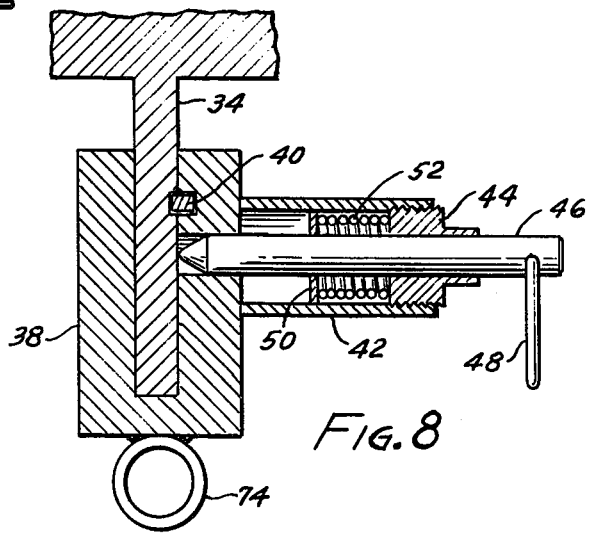
FIG. 8
FIG. 9
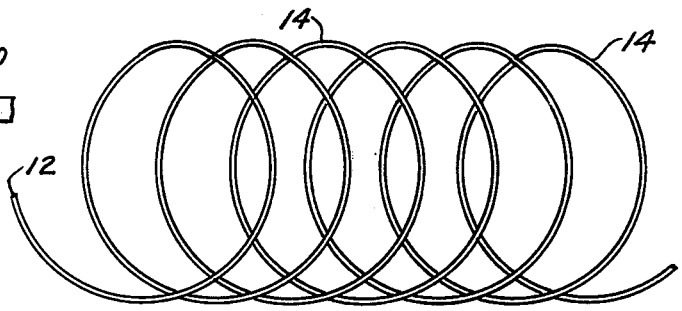

WIRE HANDLING APPARATUS

BACKGROUND OF THE INVENTION

The present invention relates to handling rod-like material or wire and is more particularly concerned with handling wire where a continuous length thereof is formed into a series of loops and thereafter deposited on a moving conveyor. As the loops fall onto the conveyor, it is desirable to have the loops form a series of non-concentric overlapping loops with substantially equal or uniform spacing between the loops. Such uniform spacing is desirable since subsequent treatment of the rod, e.g. heat treatment, may be adversely affected if such uniform spacing is not present.

As a series of concentric loops of wire are deposited on a moving conveyor there is at least initially a tendency for the wire to return to concentric loops rather than to assume a non-concentric overlapping position. This tendency is increased if the loops are allowed to bounce or vibrate immediately after their initial contact with the conveyor.

SUMMARY OF THE INVENTION

An object of this invention is to provide apparatus which accomplishes a uniform spacing between loops deposited on a moving conveyor.

The above object can be accomplished by providing an apparatus including a conveyor with spaced pins for engaging loops of wire as they fall onto a moving conveyor and guide means to limit the upward movement of the loops of wire and to contain the loops in the spaces between the pins.

BRIEF DESCRIPTION OF THE DRAWINGS

FIG. 3 is a view taken substantially along the line 3—3 of FIG. 1.

FIG. 4 is a view taken substantially along the line 4—4 of FIG. 1.

FIG. 8 is a view taken substantially along the line 8—8 of FIG. 3.

FIG. 9 is a diagrammatic view illustrating nonconcentric overlapping loops of wire.

DETAILED DESCRIPTION OF THE DRAWINGS

Figure 1:
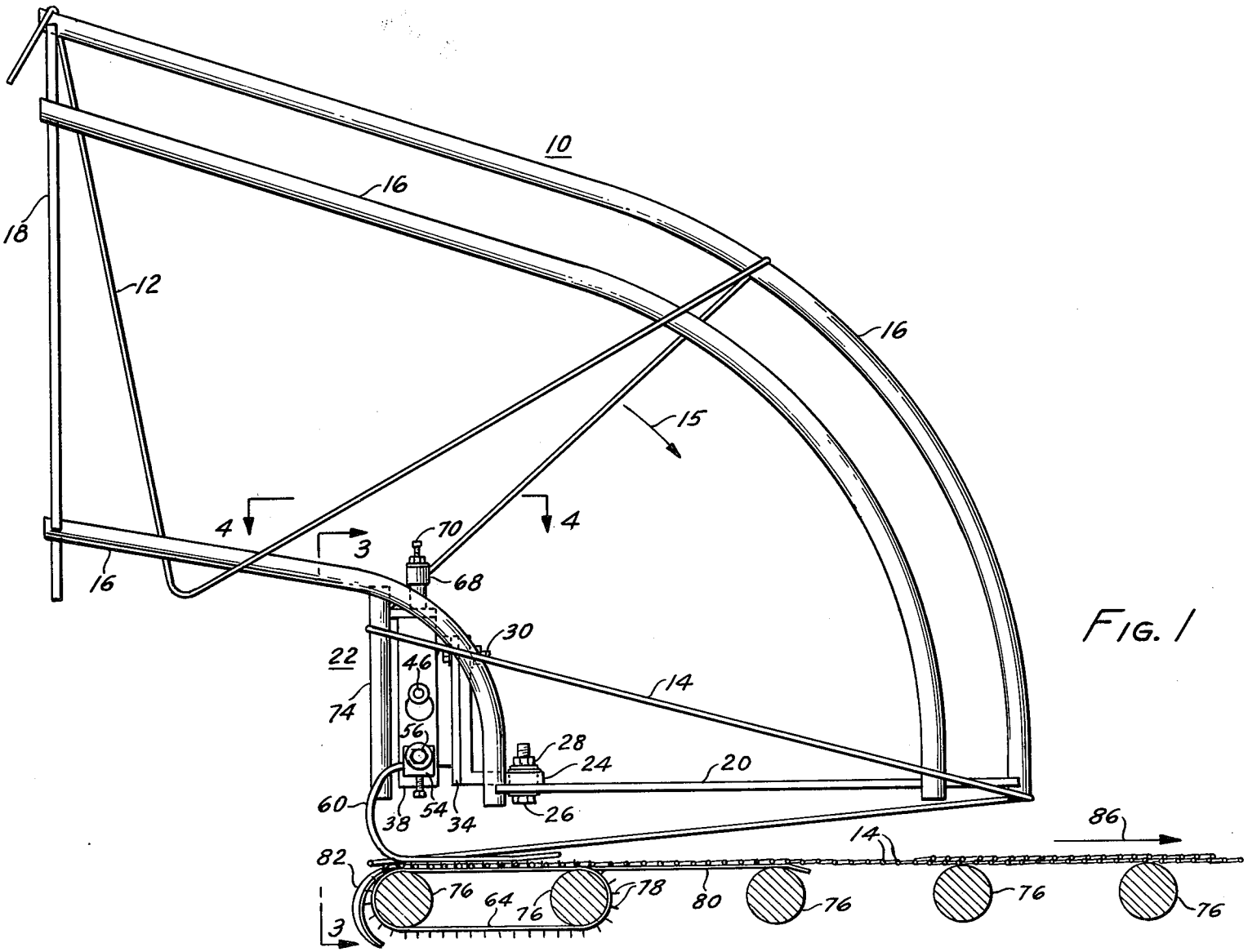
FIG. 1 is an elevational view, partly in section, of the apparatus of this invention.
Figure 2:
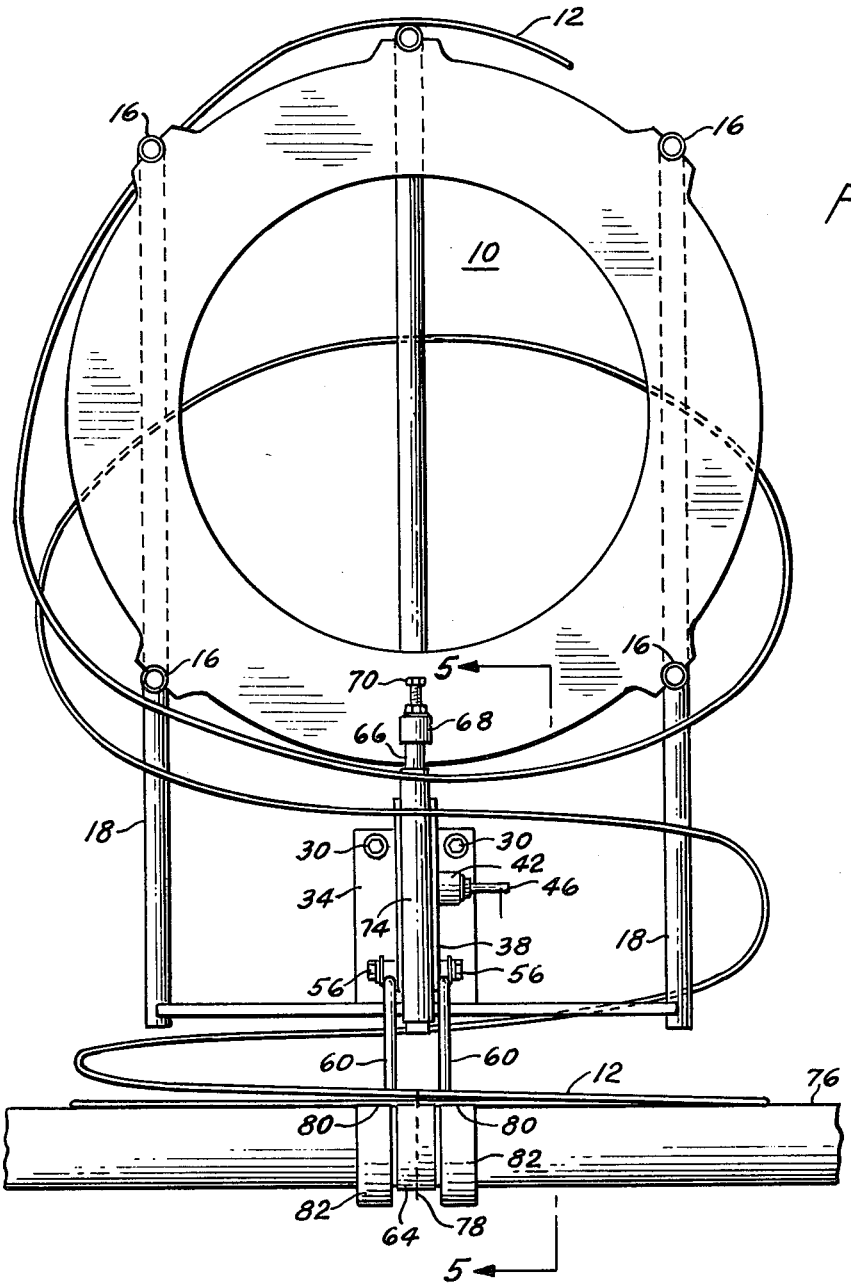
FIG. 2 is an end view of the apparatus of FIG. 1 looking in the direction of movement of the loops.

Referring to FIGS. 1 and 2, the apparatus of this invention includes support means 10 over which a continuous length of wire 12 formed into a series of loops 14 pass in the direction of arrow 15 of FIG. 1. The loops 14 are formed and released onto support means 10 by conventional apparatus (not shown) well known to those skilled in the art. The loops 14 slidably pass over support means 10 which comprises a plurality of downwardly extending members 16. The members 16 are joined at their upper ends by vertically extending member 18 and at their lower ends by horizontally extending member 20.

Figures 5, 6, 7:
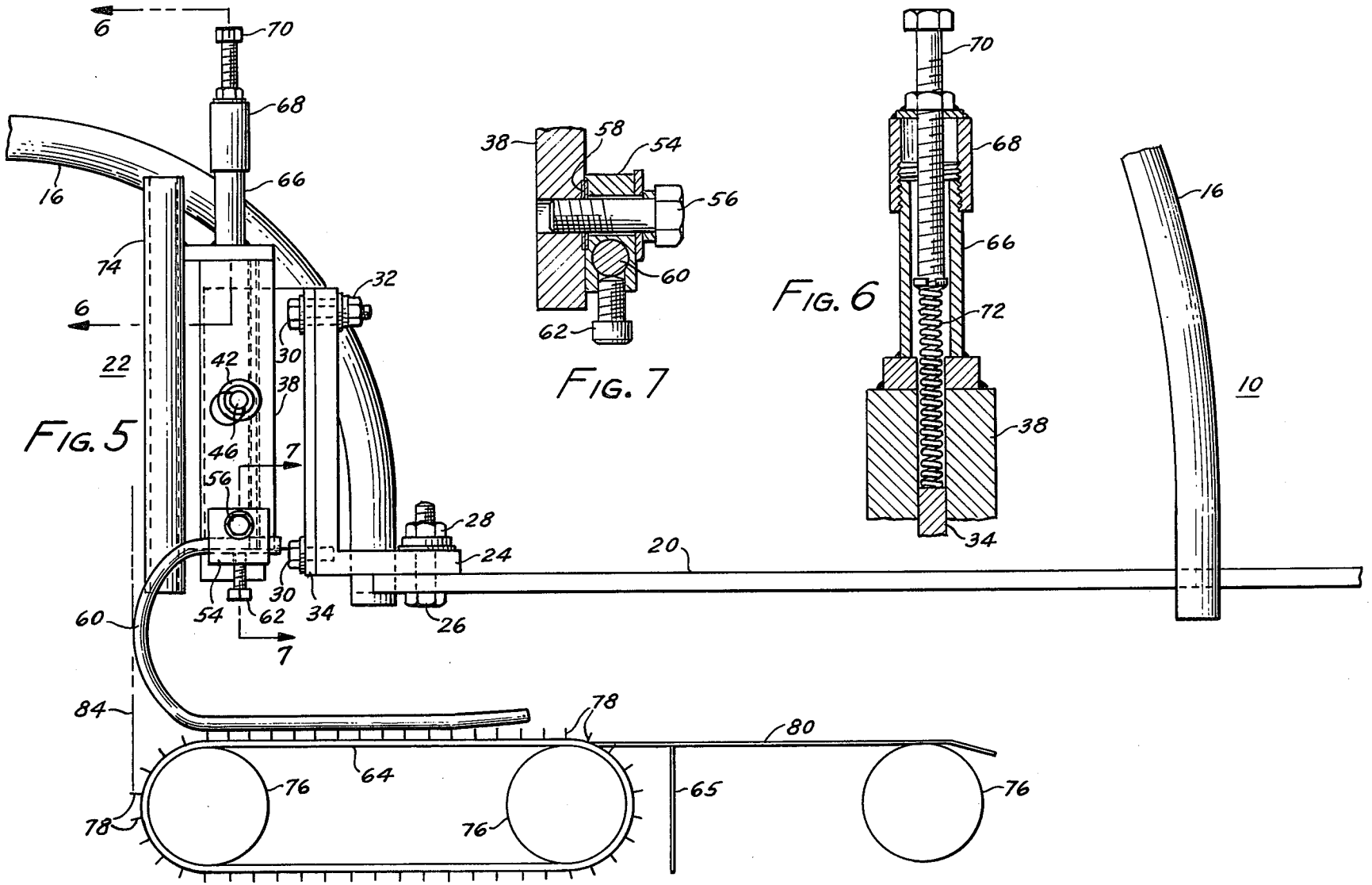
FIG. 5 is an enlarged view taken substantially along the line 5—5 of FIG. 2 with parts removed for clarity.
FIG. 6 is a view taken substantially along the line 6—6 of FIG. 5.
FIG. 7 is a view taken substantially along the line 7—7 of FIG. 5.

As best shown in FIGS. 4 and 5, guide means 22 is mounted on horizontally extending member 20 which is located at the lower end of support means 10. The mounting base for guide means 22 includes L-shaped plate 24 which is attached to member 20 by bolts 26 and nuts 28. As shown in FIG. 4 the holes 27 in plate 24, through which bolts 26 pass, are elongated to allow plate 24 to be moved horizontally relative to member 20. Attached to L-shaped plate 24 by means of bolts 30 and nuts 32 is a T-shaped plate 34. The T-shape of plate 34 is clearly shown in FIG. 8. As best seen in FIG. 3, the upper bolts 30 pass through elongated holes 36 in plate 24 in order to allow plate 34 to be angularly adjusted relative to L-shaped plate 24. Referring to FIGS. 3 and 5, a C-shaped slide 38 is slidably attached to T-shaped plate 34 for substantially vertical movement thereon. The C-shape of slide 38 is clearly shown in FIG. 8. Also shown in FIG. 8 is an alignment key 40 which extends in grooves in slide 38 and T-shaped plate 34. Key 40 maintains the proper alignment of slide 38 on plate 34 so that slide 38 will move freely on plate 34.

Referring to FIG. 8, attached to one side of slide 38 is a sleeve 42 having internal threads to receive threaded plug 44. Passing through plug 44 and an opening in slide 38 is a safety pin 46 having a ring 48 attached to the outer end thereof. Fixed to pin 46 is a spring retainer 50 which engages one end of compression spring 52 which encircles safety pin 46. The other end of compression spring 52 is in contact with the inner end of plug 44. Safety pin 46 is biased in the direction of plate 34 by spring 52. The purpose of safety pin 46 is to provide a means to support slide 38 in a raised or inoperative position. In order to so do, slide 38 is raised until safety pin 46 loses contact with plate 34 and by means of spring 52 projects across the top of plate 34. Thereafter slide 38 is supported by safety pin 46 engaging the top of plate 34. In order to lower slide 38 on plate 34, safety pin 46 is retracted by pulling on ring 48 and compressing spring 52. Thereafter, slide 38 can be lowered and safety pin 46 assumes the position shown in FIG. 8.

As best shown in FIGS. 3, 5 and 7, a guide bar mounting block 54 is adjustably secured to each side of slide 38 by means of bolt 56 which is in threaded engagement with a tapped hole in slide 38. Serrated washers 58 are positioned between the mounting block 54 and slide 38, as best seen in FIG. 7, to provide for adjusting mounting block 54 relative to slide 38. Each mounting block 54 has a through hole to receive substantially U-shaped guide bar 60. Each guide bar 60 is secured to mounting block 54 by a bolt 62 which is in threaded engagement with the mounting block 54 and bears against guide bar 60. U-shaped guide bar 60 has one leg extending adjacent and substantially parallel to conveyor belt 64 and the other leg is attached to mounting block 54.

Referring to FIGS. 3 and 6, slide 38 has secured to its top surface a sleeve 66. The upper end of sleeve 66 is externally threaded to receive the internal threads of cap 68 which has an internal threaded portion to receive adjusting bolt 70. Positioned between the upper surface of T-shaped plate 34 and the lower end of adjusting bolt 70 is a compression spring 72, shown in FIG. 6. Adjusting bolt 70 may be used to vary the position of guide bars 60 relative to conveyor belt 64. Spring 72 serves to cushion the downward movement of slide 38 on plate 34.

Referring to FIGS. 1, 2 and 4, a bumper bar 74 is secured to slide 38 and serves to guide the trailing end of a loop 14 as it passes over support means 10. Bumper bar 74 also serves as a wear surface for slide 38. Bumper bar 74 may be formed from a tubular section.

Referring to FIGS. 1 and 5, a plurality of power driven rollers 76 are located below support means 10. Two of such rollers 76 drive conveyor belt 64 which is a continuous belt having spaced pins 78 extending outwardly therefrom. The spacing between and the height of the pins 78 should be a distance greater than the largest diameter of wire to be handled by the apparatus of this invention. As best seen in FIG. 3, conveyor belt 64 extends between and substantially parallel to guide bars 60. In addition, guide bars 60 have their lower surfaces at a slightly lower elevation than the top surfaces of pins 78 when such pins 78 are extending upwardly from conveyor belt 64.

Referring to FIGS. 2 and 5, and extending parallel to and at a fixed elevation slightly lower than the top surface of conveyor belt 64 is a pair of table means 80 attached to fixed upright 65, shown in FIG. 5. As best seen in FIG. 2, a conveyor belt 64 extends between the pair of table means 80. The table means 80 supports the weight of the loops of wire 14 and prevents the conveyor belt 64 from becoming depressed out of engagement with the loops of wire 14.

As shown in FIG. 1, arcuate guard means 82 surrounds a portion of roller 76 located at the trailing edge of the conveyor belt 64. Guard means 82 supports the trailing end of a loop 14 and supports such loop 14 prior to engagement of such loop 14 by a pin 78 of conveyor belt 64. Guard means 82 may be an extension of table means 80 or separate therefrom. For sake of clarity, guard means 82 is not shown in FIG. 5.

Operation

In preparing to place the apparatus of this invention into operation the following adjustments may be necessary in order to properly position the guide bars 60 as set forth below:

(A) Referring to FIG. 5, the guide bars 60 are moved horizontally so that a vertical plane illustrated by line 84 in FIG. 5 passes tangent to the outermost surface of the curved portions of U-shaped guide bars 60 and intersects with the length of a pin 78 which is extending horizontally from conveyor belt 64. Such horizontal movement may be accomplished by adjusting the location of bolts 26 in the elongated holes 27 in L-shaped plate 24 and/or by adjusting the position of guide bars 60 in the horizontal holes in guide bar mounting block 54. Such latter adjustment may be made by loosening bolts 62, adjusting guide bars 60 and tightening bolts 62 to secure guide bars 60 in the proper position.

(B) Referring to FIGS. 3 and 5, the legs of U-shaped guide bars 60 which are adjacent the conveyor belt 64 should be adjusted to extend substantially parallel to conveyor belt 64. Referring to FIG. 7, such adjustment may be made by loosening bolts 56 and rotating the mounting blocks 54 to the proper position and thereafter tightening bolts 56 to secure the guide bars in such parallel position.

(C) Referring to FIG. 3, the lowermost surfaces of the guide bars 60 should be in a plane which is substantially parallel to a plane passing through the top surface of conveyor belt 64. The guide bars 60 can be so positioned by loosening bolts 30 which secure T-shaped plate 34 to L-shaped plate 24 and rotating T-shaped plate 34 about lower bolt 30 so that upper bolts 30 move within the elongated holes 36 in L-shaped plate 24. Thereafter, bolts 30 are tightened to secure T-shaped plate 34 in such position.

(D) Referring to FIG. 3, the elevation of the lowermost surfaces of guide bars 60 should be adjusted so that such surfaces are at a slightly lower elevation than the uppermost surfaces of the pins 78 which extend upwardly from conveyor belt 64. Such adjustment can be made by means of bolt 70 shown in FIG. 6.

After the above adjustments are made, the appartatus is ready to be placed in operation. During operation, loops 14 of wire 12 are passed one at a time onto support means 10 by apparatus not shown but well known in the art. As the loops of wire pass onto support means 10, the loops 14 slide downwardly in the direction of arrow 15 of FIG. 1. As the loops 14 descend on support means 10, the trailing end of the loops contact bumper bar 74, slide down bumper bar 74 and contact the curved portion of U-shaped guide bars 60. Thereafter, the loops 14 fall onto guard 82 and are later engaged by pins 78 of conveyor belt 64. As the pins 78 move the loops horizontally in the direction of arrow 86 of FIG. 1, the upper surfaces of loops 14 are contacted by the lower surfaces of guide bars 60. Thus, guide bars 60 eliminate the tendency for loops 14 to bounce or vibrate on conveyor belt 64 and, in addition, contain loops 14 within the spacing between pins 78 of conveyor belt 64. In so doing, substantially uniformly spaced, non-concentric overlapping loops are provided on the conveyor means as diagrammatically illustrated in FIG. 9. The leading end of the loops 14 fall from uppermost member 16 onto power driven rollers 76 which in addition to belt conveyor 64 move the loops in the direction of arrow 86 of FIG. 1.

Although this invention has been described hereinabove in considerable detail, it should not be limited narrowly to the exact and specific particulars disclosed, but it may also include such substitutes, modifications, or equivalents as are within the scope and spirit of the invention or pointed out in the appended claims.

We claim:

1. In apparatus including support means over which a continuous length of wire formed into a series of loops pass and are deposited on conveyor means whereby due to the motion of the conveyor means relative to the support means the loops fall onto the conveyor means to form a series of non-concentric overlapping loops, the improvement comprising:

(a) said conveyor means includes a conveyor belt positioned below said support means and having spaced pins extending therefrom for engaging said loops to control the spacing between said loops on said conveyor means, and (b) guide means mounted on the lower end of said support means to engage an upper surface of said loops on said conveyor means to limit the upward movement of said loops and thereby contain said loops in the spaces between said pins.

2. The apparatus of claim 1 further comprising table means extending on both sides of said conveyor belt to support said loops.

3. The apparatus of claim 1 wherein the guide means of paragraph (b) includes a mounting base attached to the lower end of said support means, a slide mounted on said mounting base for vertical movement thereon, a pair of U-shaped guide bars with each guide bar having one leg attached to said slide and the other leg extending substantially parallel to and spaced above said conveyor belt.

4. The apparatus of claim 3 wherein said bars are vertically and horizontally adjustable relative to said conveyor belt.

5. The apparatus of claim 4 wherein said slide is supported on said mounting by means of screw means and spring means.

6. The apparatus of claim 5 further comprising table means extending on both sides of said conveyor belt to support said loops.

7. The apparatus of claim 6 further comprising guard means surrounding a portion of a roll for said conveyor belt to support the trailing end of said loops prior to engagement of said loops by said pins.

* * * * *